US007591736B2

(12) United States Patent
Ban

(10) Patent No.: US 7,591,736 B2
(45) Date of Patent: Sep. 22, 2009

(54) GOLF CLUB HEAD

(75) Inventor: Wataru Ban, Saitama (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 361 days.

(21) Appl. No.: 11/643,763

(22) Filed: Dec. 22, 2006

(65) Prior Publication Data

US 2007/0149314 A1 Jun. 28, 2007

(30) Foreign Application Priority Data

Dec. 28, 2005 (JP) ..... 2005-378100

(51) Int. Cl.
*A63B 53/04* (2006.01)

(52) U.S. Cl. ..... 473/329; 473/332; 473/342; 473/345

(58) Field of Classification Search ..... 473/324–350, 473/287–292, 219–238
See application file for complete search history.

(56) References Cited

U.S. PATENT DOCUMENTS 4,928,965 A * 5/1990 Yamaguchi et al. ..... 473/332
5,064,197 A * 11/1991 Eddy ..... 473/326
5,351,952 A * 10/1994 Hackman ..... 473/409
6,481,088 B1 * 11/2002 Inoue et al. ..... 29/527.5
7,086,963 B1 * 8/2006 Onuki et al. ..... 473/342
7,097,572 B2 * 8/2006 Yabu ..... 473/329
7,241,230 B2 * 7/2007 Tsunoda ..... 473/324
7,261,643 B2 * 8/2007 Rice et al. ..... 473/329
2006/0068932 A1 * 3/2006 Rice et al. ..... 473/329

FOREIGN PATENT DOCUMENTS

JP 2002-17904 A 1/2002
JP 2003-339919 A 12/2003
JP 2004-135858 A 5/2004
JP 2005-6763 A 1/2005

* cited by examiner

*Primary Examiner*—Sebastiano Passaniti
(74) *Attorney, Agent, or Firm*—Sughrue Mion, PLLC

(57) ABSTRACT

A hollow golf club head has a face portion, a crown portion, and a sole portion. Assuming that a primary deflection mode frequency of the face portion is Ff, a primary deflection mode frequency of the crown portion is Fc, and a primary deflection mode frequency of the sole portion is Fs, the Ff, Fc and Fs satisfy the following expressions: 3000 Hz<Ff<4000 Hz; 3000 Hz<Fc<4000 Hz; Fs>4000 Hz. The face portion, the crown portion and the sole portion have no mode frequency of 3000 Hz or less.

12 Claims, 3 Drawing Sheets

GOLF CLUB HEAD

BACKGROUND OF THE INVENTION

1. Field of the Invention

The present invention relates to a hollow golf club head in which the vibration characteristics of a face portion, a crown portion and a sole portion are controlled to optimize the carry and the hit ball sound.

2. Description of the Related Art

Conventional, it has been proposed that the vibration characteristics of a golf club head are controlled to improve the performance (shot sound and bounce) of the golf club head.

For example, JP-A-2005-6763 discloses a design method for a golf club head, including a step of primarily designing the golf club head, a step of acquiring the vibration characteristics for the golf club head through the mode analysis on a computer, a step of manufacturing the golf club head experimentally and sampling the hit ball sound, a step of specifying the improvements for improving the hit ball sound based on the hit ball sound and the vibration characteristics, and a step of secondarily designing the golf club head by applying the above improvements.

JP-A-2004-135858 discloses a metallic hollow golf club head of wood type in which the ratio of the primary natural frequency of the face portion to the primary natural frequency of the sole portion is from 0.95 to 1.05 in the characteristic vibration measurement by a centrally supporting stationary excitation method employing an electromagnetic excitation unit or a suspension blow excitation method employing an impulse hammer.

JP-A-2003-339919 discloses a golf club head in which the primary fixed natural frequency of a golf club head in a state where the central part of the face portion is restrained is from 500 Hz to 900 Hz, and the primary free natural frequency of the golf club head in an unrestrained state is from 3000 Hz to 5000 Hz.

JP-A-2002-17904 discloses a golf club head in which the natural frequency of the head portion to be measured at a sweet spot is smaller than the natural frequency of the golf ball.

Conventionally, it is common practice that the face portion is made less elastic by measuring the vibration of only the face portion, and setting the primary frequency (primary natural frequency) of the face portion to a low frequency, whereby increasing the initial velocity of the hit ball.

SUMMARY OF THE INVENTION

However, to increase the initial velocity of the hit ball, not only the vibration frequency of the face portion but also the vibration mode (way of movement) are important factors. Also, even if the vibration characteristic of the face portion is only defined, it is insufficient to optimize the carry and the shot sound. Even if the primary frequency of the face portion is set to the low frequency, there is an adverse effect on the shot sound.

An object of the invention to provide a hollow golf club head in which the carry and the shot sound are optimized by controlling the vibration characteristics of a face portion, a crown portion and a sole portion.

The present inventor has found that the carry and the shot sound are adversely affected by not only the vibration of the face portion but also by the vibration characteristics of the crown portion and the sole portion. Thus, in order to optimize the carry and the shot sound, it is required to control the vibration characteristics of the face portion, the crown portion and the sole portion. Also, it is important for optimizing the carry and the shot sound to define the primary deflection mode frequencies of the face portion, the crown portion and the sole portion as the vibration characteristics.

The invention has been achieved based on the above knowledge and provides a hollow golf club head having a face portion, a crown portion and a sole portion, wherein assuming that a primary deflection mode frequency of the face portion is Ff, a primary deflection mode frequency of the crown portion is Fc, and a primary deflection mode frequency of the sole portion is Fs, Ff, Fc and Fs satisfy the following expressions (1), (2) and (3), $$3000\ \text{Hz} < Ff < 4000\ \text{Hz} \quad (1)$$

$$3000\ \text{Hz} < Fc < 4000\ \text{Hz} \quad (2)$$

$$Fs > 4000\ \text{Hz} \quad (3)$$

and the face portion, the crown portion and the sole portion have no mode frequency of 3000 Hz or less.

The above-described golf club head has an increased carry and excellent shot sound.

DETAILED DESCRIPTION OF THE PREFFERED EMBODIMENTS

Figure 1:
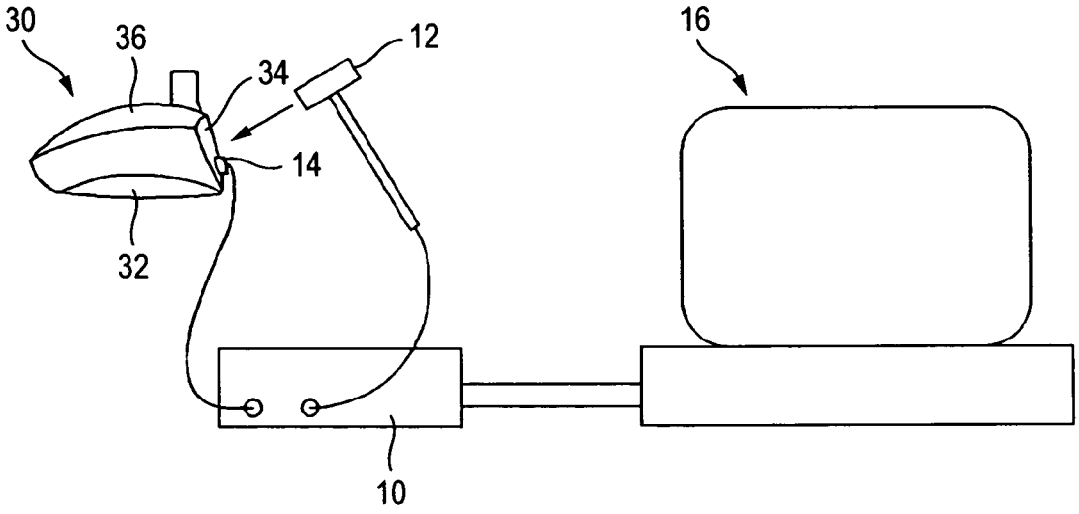
FIG. 1 is a schematic view showing a vibration characteristic measurement instrument for a golf club head for use in an example.

The present invention will be described below in more detail. A golf club head according to an embodiment of the invention has a face portion, a crown portion, and a sole portion. The face portion is a front portion of the golf club head for hitting the ball. The sole portion is the portion extending from a lower part of the face portion backward and forming a bottom part of the head. The crown portion is the portion extending backward from an upper part of the face portion and forming an upper part of the head. Also, the golf club head may have a side portion or a hosel portion. The side portion is the portion extending backward from between the upper part and the lower part of the face portion and forming a lateral part. This side portion comprises a toe side portion, a heel side portion, and a back side portion. The hosel portion is the portion for fixing a shaft.

Also, in this embodiment, the primary deflection mode frequency of each portion is the frequency in a mode where only one abdomen of vibration exists in each portion, but is not a return mode or bending mode. The measurement method for the primary deflection mode frequency is not limited, but the primary deflection mode frequency can be measured by the method for exciting the golf club head to acquire a frequency response function as in an example as will be described later, for example. In this case, in making the excitation, a method for applying an excitation force to each measurement point of the golf club head and measuring the response vibration at a certain point (excitation point moving method), or a method for applying an excitation force to a certain point of the golf club head and measuring the response vibration of each measurement point (response point moving method) may be adopted.

In this embodiment, assuming that the primary deflection mode frequency of the face portion is Ff, the primary deflection mode frequency of the crown portion is Fc, and the primary deflection mode frequency of the sole portion is Fs, Ff, Fc and Fs satisfy the expressions (1), (2) and (3) as previously described. If Ff is less than or equal to 3000 Hz, the shot sound is worse, and if Ff is greater than or equal to 4000 Hz, the initial velocity is slower. If Fc is less than or equal to 3000 Hz, the shot sound is worse, and if Fc is greater than or equal to 4000 Hz, the launch angle is smaller. If Fs is less than or equal to 4000 Hz, the launch angle is smaller.

The more preferable ranges of Ff, Fc and Fs are shown by the following expressions (4), (5) and (6).

$$3000\ \text{Hz} < Ff < 3500\ \text{Hz} \quad (4)$$

$$3000\ \text{Hz} < Fc < 3500\ \text{Hz} \quad (5)$$

$$5500\ \text{Hz} > Fs > 4500\ \text{Hz} \quad (6)$$

Also, in this embodiment, the face portion, the crown portion and the sole portion have no mode frequency of 3000 Hz or less. That is, each portion has no mode frequency within a frequency range of 3000 Hz or less. If any of those portions has a mode frequency of 3000 Hz or less, the shot sound is worse.

In the golf club head, means for allowing Ff, Fc and Fs to satisfy the expressions (1), (2) and (3) and preventing the face portion, the crown portion and the sole portion from having the mode frequency of 3000 Hz or less may be, but not limited to, means for adjusting various parameters such as thickness, area and curvature of the face portion, the crown portion and the sole portion, means for choosing the material of each portion, or means for providing a rib on one or more of those portions.

In this case, the vibration characteristics of the face portion have influence on the initial velocity and the shot sound, in which if the face portion is less stiff by reducing Ff, the initial velocity is greater and the carry is increased, but if the face portion is excessively less stiff, the shot sound is worse. The vibration characteristics of the crown portion have influence on the launch angle and the shot sound, in which if the crown portion is made less stiff by reducing Fc, the launch angle is greater and the carry is increased, but if the crown portion is excessively less stiff, the shot sound is worse. The vibration characteristics of the sole portion have influence on the launch angle and the shot sound, in which if the sole portion is made harder by increasing Fs, the launch angle is greater and the carry is increased, but if the sole portion is excessively less stiff, the shot sound is worse.

In this embodiment, the damping ratio of Ff, Fc and Fs is preferably 0.3 or less. The damping ratio means an index indicating the easiness of the vibration settling. As the damping ratio is greater, the vibration is easier to settle, and as the damping ratio is smaller, the vibration is more difficult to settle. If the damping ratio of Ff, Fc and Fs is in the above range, the extensional shot sound is attained. A more preferable range of damping ratio is from 0.1 to 0.25.

In this embodiment, it is preferred that the volume of the golf club head is 350 $cm^3$ or more. That is, the golf club head having a larger volume has generally a lower natural frequency, and has a tendency that the shot sound is worse. If the invention is applied to the golf club head having a large volume, the golf club head is excellent in the shot sound. A more preferable range of volume of the golf club head is from 380 to 470 $cm^3$.

In the golf club head, it is preferred that the characteristic time is 257 μsec or less in a pendulum test as defined by USGA (United States Golf Association). The pendulum test as defined by USGA involves calculating the characteristic time from the contact time when a metal ball is collided like a pendulum against the face and measuring the SLE (Spring Like Effect) of the golf club. In this embodiment, the initial velocity is increased by making the face portion less elastic, but when the characteristic time in the pendulum test is 257 μsec or less, the golf club adaptable to the rules of USGA can be produced.

Though the manufacturing method for the golf club head is not limited, the golf club head may be manufacture by closing a face opening portion of the head main body with a face member, for example. In this case, though the material or molding method of the head main body is not limited, the material may be titanium, titanium alloy, stainless steel or amorphous. The molding method may be a casting method. Though the material or molding method of the face member is not particularly limited, the material may be titanium, titanium alloy, stainless steel or amorphous. The molding method may be a forging method, a press forming method or a die-cast method. Also, though the joining method for the head main body and the face member is not limited, the plasma welding, laser welding or electron beam welding may be suitable in the respect of finishing the joined part finely and improving the weight precision of the golf head.

EXAMPLES (Vibration Characteristic Measuring Method)

First of all, a vibration characteristic measuring method for the golf club head will be described below. In this example, a vibration characteristic measuring apparatus as shown in FIG. 1 was employed. In FIG. 1, reference numeral 10 denotes a data station, reference numeral 12 denotes an impulse hammer, reference numeral 14 denotes an accelerometer, and reference numeral 16 denotes a general-purpose personal computer (PC) for analyzing the vibration characteristics. The impulse hammer 12, the accelerometer 14 and the PC 16 are all connected to the data station 10. Also, the PC 16 contains the FFT (Fast Fourier Transform) analysis software for calculating a frequency response function and the modal analysis software for calculating the modal parameters.

Specifically, the following units were employed.

Data station 10: DS2000 made by Ono Sokki
Impulse hammer 12: 5800SL made by DYTRAN
Accelerometer 14: NP3210 made by Ono Sokki
FFT analysis software: DS0221 made by Ono Sokki
Modal analysis software: Visual Modal made by Vibrant Technology In this example, the vibration characteristics for the golf club head were measured in accordance with the following procedure.

(1) The golf club head (measured head) to be measured was prepared, and the measuring points were decided. The number of measuring points was about 100.

Figure 2:
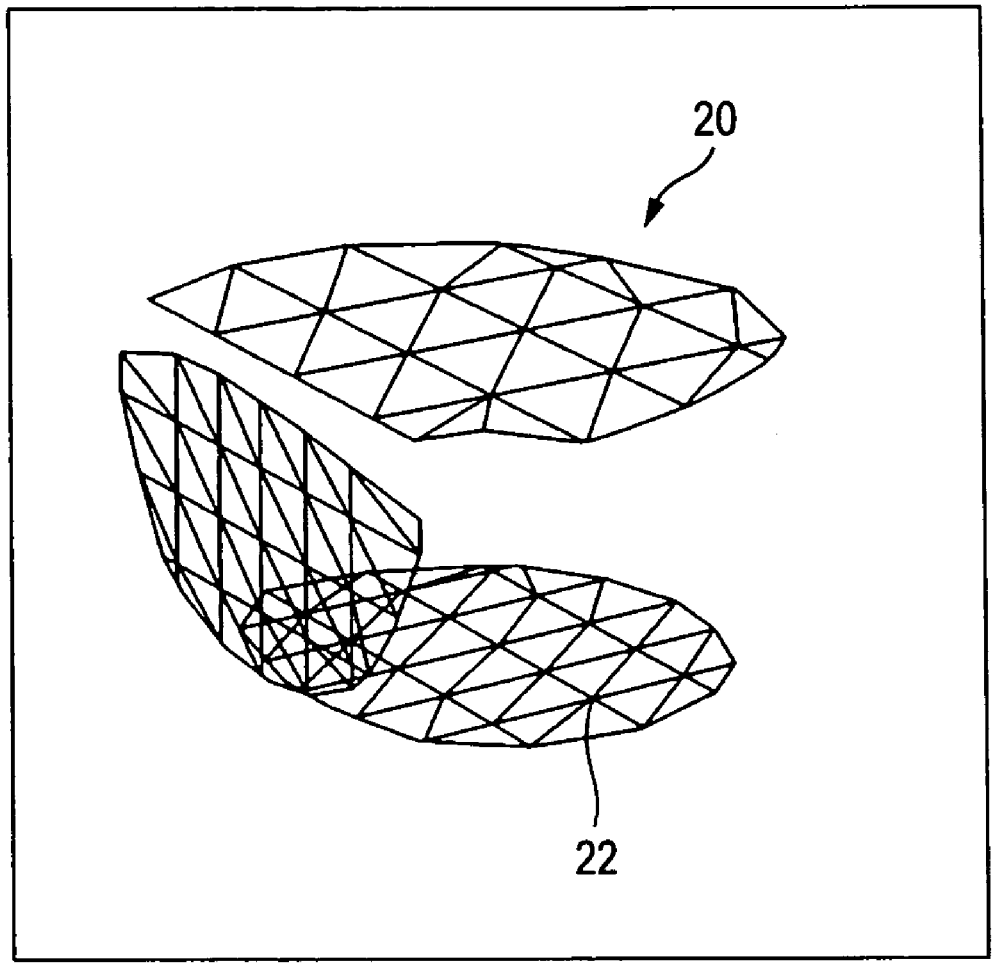
FIG. 2 is a 3D view showing a model of a measured head fabricated in the example.

(2) A model of the measured head was created on the PC 16. FIG. 2 is a 3D view of the model 20. A point of intersection 22 between the lines is each measuring point.

(3) The frequency response function was measured by an excitation point moving method, using an instrument as shown in FIG. 1. In this case, the accelerometer 14 was bonded with a face portion 34 (preferably face peripheral part) of a measured head 30 by adhesives, and an excitation force was applied to the face portion 34, the crown portion 36 and the sole portion 32 by an impulse hammer 12, as shown in FIG. 1. The measured head 30 was placed on a sponge mat made of polyurethane to make the measurement, but the measured head 30 may be preferably suspended in the air to make the measurement.

Figure 3:
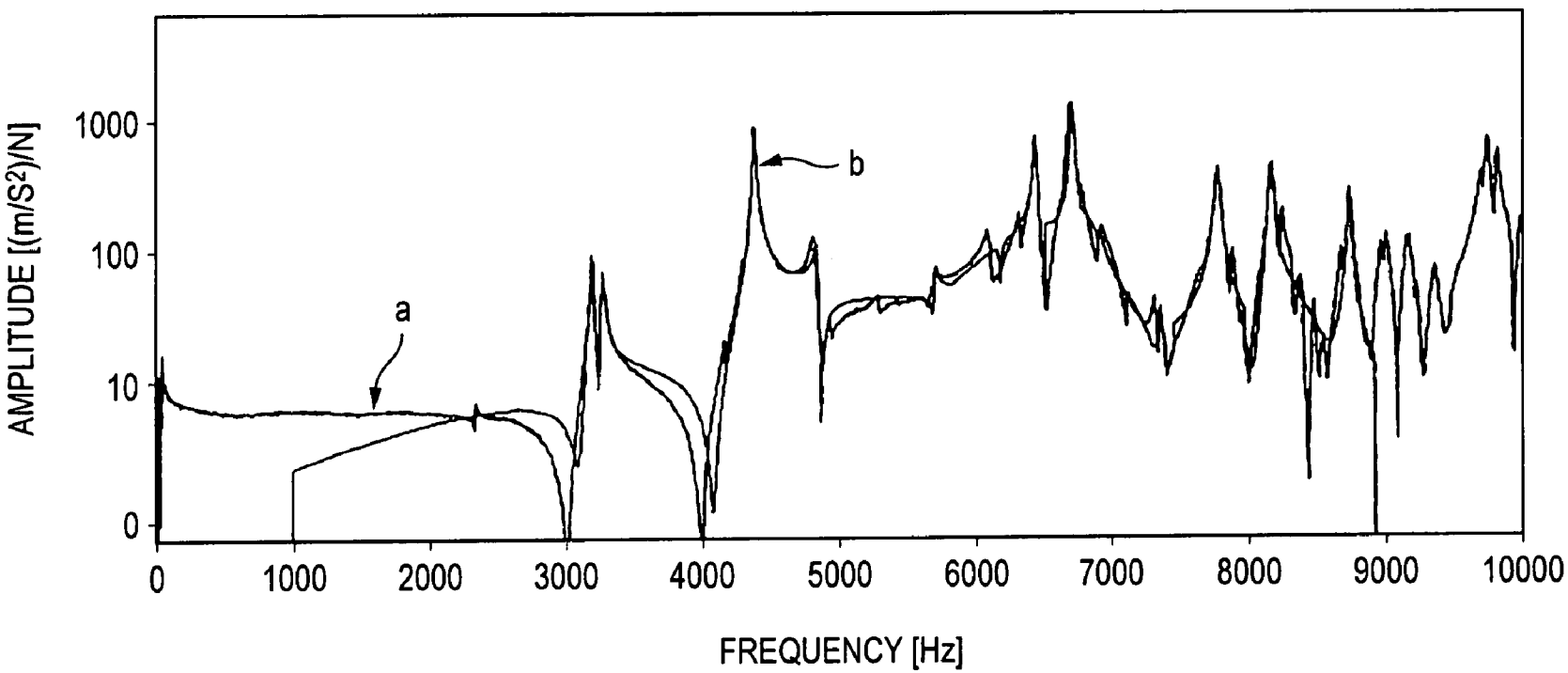
FIG. 3 is a graph showing one of a frequency response function measured in the example.

(4) The frequency response function was measured and the modal analysis was made using the PC 16. Specifically, the curve fitting, the calculation of modal parameters (characteristic value, damping ratio, amplitude, phase) and the mode animation were performed. FIG. 3 shows one example of the analysis results of the frequency response function. In FIG. 3, a is the actual measurement value, and b is the theoretical value of curve fitting.

(5) The vibration portion and the way of vibration in each mode were observed, and the primary deflection mode and its frequency of each portion were specified.

Example

The golf club head was fabricated by fixing the face member to the face opening portion of the head main body. The material of the head main body was 6-4Ti (Ti-6Al-4V), and the material of the face member was SAT2041 (Ti-20V-4Al-1Sn). In this case, the golf club heads with the values of Ff, Fc and Fs in the example and the comparative examples 1 to 3 as shown in Table 1 were fabricated by changing the thickness of the face portion, the crown portion and the sole portion. That is, if the thickness is greater, the rigidity is increased and the primary deflection mode frequency is higher, while if the thickness is smaller, the rigidity is decreased and the primary deflection mode frequency is lower. Accordingly, the rigidity and the primary deflection mode frequency can be changed by controlling the thickness.

For the golf club heads in the example and the comparative examples 1 to 3, Ff, Fc and Fs were measured by the vibration characteristic measuring method. The results are shown in Table 1. The criteria for evaluation in Table 1 are as follows.

Initial velocity oo: High initial velocity

Initial velocity x: Slow initial velocity

Launch angle oo: Large launch angle

Launch angle Δ: Slightly small launch angle

Shot sound oo: Excellent shot sound

Shot sound x: Bad shot sound

TABLE 1

| | Example | Comparative example 1 | Comparative example 2 | Comparative example 3 |
|---|---|---|---|---|
| Ff (Hz) | 3500 | 3500 | 3500 | 4500 |
| Fs (Hz) | 5000 | 5000 | 2500 | 5000 |
| Fc (Hz) | 3500 | 4500 | 3500 | 3000 |
| Initial velocity | oo | oo | oo | x |
| Launch angle | oo | Δ | oo | oo |
| Shot sound | oo | oo | x | oo |

From Table 1, it was confirmed that the initial velocity was high, the launch angle was large, and the shot sound was excellent if Ff, Fc and Fs satisfied the expressions (1), (2) and (3). On the contrary, if Ff was 4000 Hz or more, the initial velocity was lower, if Fc was 4000 Hz or more, the launch angle was small, and if any of Ff, Fs and Fc was 3000 Hz or less, the shot sound was worse.

What is claimed is:

1. A hollow golf club head comprising:

a face portion;

a crown portion; and a sole portion, wherein assuming that a primary deflection mode frequency of the face portion is Ff, a primary deflection mode frequency of the crown portion is Fc, and a primary deflection mode frequency of the sole portion is Fs, the Ff, Fc and Fs satisfy the following expressions (1), (2) and (3), $$3000\ \text{Hz} < Ff < 4000\ \text{Hz} \quad (1)$$

$$3000\ \text{Hz} < Fc < 4000\ \text{Hz} \quad (2)$$

$$Fs > 4000\ \text{Hz} \quad (3)$$

and the face portion, the crown portion and the sole portion have no mode frequency of 3000 Hz or less, wherein the face portion is a front portion of the golf club head for hitting a ball, the sole portion is a portion of the golf club head extending from a lower part of the face portion backward and forming a bottom part of the golf club head, and the crown portion is a portion of the golf club head extending backward from an upper part of the face portion and forming an upper part of the golf club head, and the golf club head has a hallow cavity defined therein.

2. The golf club head according to claim 1, wherein a damping ratio of each of the Ff, Fc and Fs is 0.3 or less.

3. The golf club head according to claim 2, wherein a characteristic time in a pendulum test as defined by USGA (United States Golf Association) is 257 μsec or less.

4. The golf club head according to claim 1, wherein a head volume is 350 $cm^3$ or more.

5. The golf club head according to claim 4, wherein a characteristic time in a pendulum test as defined by USGA (United States Golf Association) is 257 μsec or less.

6. The golf club head according to claim 2, wherein a head volume is 350 $cm^3$ or more.

7. The golf club head according to claim 6, wherein a characteristic time in a pendulum test as defined by USGA (United States Golf Association) is 257 μsec or less.

8. The golf club head according to claim 1, wherein a characteristic time in a pendulum test as defined by USGA (United States Golf Association) is 257 μsec or less.

9. The golf club head according to claim 1, wherein the Ff, Fc and Fs satisfy the following expressions (4), (5) and (6), $$3000\ \text{Hz} < Ff < 3500\ \text{Hz} \quad (4)$$

$$3000\ \text{Hz} < Fc < 3500\ \text{Hz} \quad (5)$$

$$5500\ \text{Hz} > Fs > 4500\ \text{Hz} \quad (6).$$

10. The golf club head according to claim 1, wherein a damping ratio of each of the Ff, Fc and Fs is from 0.1 to 0.25.

11. The golf club head according to claim 1, wherein a head volume is from 380 $cm^3$ to 470 $cm^3$.

12. The golf club head according to claim 1, wherein the primary deflection mode frequency of each of the face portion, the crown portion and the sole portion is a frequency in a mode where only one abdomen of vibration exists in each of the face portion, the crown portion and the sole portion, but not a return mode or a bending mode.

* * * * *